US010836985B2

(12) United States Patent
Anthony et al.

(10) Patent No.: US 10,836,985 B2
(45) Date of Patent: Nov. 17, 2020

(54) SOLID COMPOSITION COMPRISING FREE AND ENCAPSULATED FRAGRANCES

(71) Applicant: TAKASAGO INTERNATIONAL CORPORATION, Tokyo (JP)

(72) Inventors: Olivier Anthony, Holland Hill (SG); Stuart Fraser, Cheshire (GB); Jonathan Warr, Paris (FR); Barbara Renoud, Paris (FR)

(73) Assignee: TAKASAGO INTERNATIONAL CORPORATION, Tokyo (JP)

( * ) Notice: Subject to any disclaimer, the term of this patent is extended or adjusted under 35 U.S.C. 154(b) by 51 days.

(21) Appl. No.: 16/323,430

(22) PCT Filed: Aug. 8, 2017

(86) PCT No.: PCT/JP2017/028830
§ 371 (c)(1),
(2) Date: Feb. 5, 2019

(87) PCT Pub. No.: WO2018/030431
PCT Pub. Date: Feb. 15, 2018

(65) Prior Publication Data

US 2020/0190445 A1 Jun. 18, 2020

(30) Foreign Application Priority Data

Aug. 9, 2016 (EP) ..... 16306041

(51) Int. Cl.

| | |
|---|---|
| ***C11D 17/00*** | (2006.01) |
| ***C11D 17/04*** | (2006.01) |
| ***C11D 1/72*** | (2006.01) |
| ***C11D 3/04*** | (2006.01) |
| ***C11D 3/37*** | (2006.01) |
| ***C11D 3/50*** | (2006.01) |

(52) U.S. Cl.
CPC ..... *C11D 17/042* (2013.01); *C11D 1/72* (2013.01); *C11D 3/046* (2013.01); *C11D 3/3707* (2013.01); *C11D 3/505* (2013.01)

(58) Field of Classification Search
CPC ..... C11D 3/505; C11D 3/50; C11D 17/0039; C11D 3/3707; C11D 17/06; C11D 17/041; C11D 17/044; C11D 3/502; C11D 3/507; C11D 17/00; C11D 17/0052
See application file for complete search history.

(56) References Cited

U.S. PATENT DOCUMENTS

| | | | | |
|---|---|---|---|---|
| 4,209,417 | A | 6/1980 | Whyte | |
| 7,867,968 | B1 | 1/2011 | Aouad | |
| 7,871,976 | B1 | 1/2011 | Aouad | |
| 9,347,022 | B1 | 5/2016 | Frentzel et al. | |
| 2005/0227905 | A1 | 10/2005 | Heinz et al. | |
| 2010/0192311 | A1* | 8/2010 | Magennis | C11D 3/48 8/142 |
| 2012/0270765 | A1 | 10/2012 | Aouad | |
| 2013/0267454 | A1 | 10/2013 | Aouad | |
| 2016/0024443 | A1 | 1/2016 | Aouad | |
| 2016/0369211 | A1* | 12/2016 | Dykstra | C11D 17/06 |
| 2017/0107458 | A1* | 4/2017 | Frankenbach | C11D 17/04 |
| 2017/0226690 | A1* | 8/2017 | Brain | D06M 13/005 |
| 2017/0283747 | A1 | 10/2017 | Aouad | |

FOREIGN PATENT DOCUMENTS

| | | | |
|---|---|---|---|
| EP | 1 061 124 | A1 | 12/2000 |
| EP | 2 496 679 | | 5/2011 |
| GB | 1 549 432 | A | 8/1979 |
| WO | 02/26928 | A1 | 4/2002 |
| WO | 2004/105811 | A1 | 12/2004 |
| WO | 2011/056938 | A1 | 5/2011 |
| WO | 2016/078941 | A1 | 5/2016 |

OTHER PUBLICATIONS

International Search Report (PCT/ISA/210) dated Oct. 19, 2017 issued by the International Searching Authority in counterpart International Application No. PCT/JP2017/028830.
Written Opinion (PCT/ISA/237) dated Oct. 19, 2017 issued by the International Searching Authority in counterpart International Application No. PCT/JP2017/028830.

* cited by examiner

*Primary Examiner* — John R Hardee
(74) *Attorney, Agent, or Firm* — Sughrue Mion, PLLC

(57) ABSTRACT

A solid composition contains (a) from 30 to 65% by weight of a polyethylene glycol, (b) from 0 to 40% by weight of a $C_8$-$C_{22}$-alkyl polyalkoxylate including at least 40 alkoxylate units, (c) from 0.5 to 15% by weight of free fragrance, (d) from 0.1 to 15% by weight of encapsulated fragrance, and (e) from 1 to 35% by weight of an alkaline metal salt, alkaline earth metal salt or salt of an inorganic or $C_1$-$C_6$-alkyl organic acid, or mixture thereof.

24 Claims, No Drawings

SOLID COMPOSITION COMPRISING FREE AND ENCAPSULATED FRAGRANCES

TECHNICAL FIELD

The present invention relates to a solid composition comprising both free fragrance and encapsulated fragrance, and to its presentation in the form of, for example, pellets, particularly suited for application in laundry. The invention also relates to the use of this solid composition as a laundry product, fabric softener or household cleaner. Finally, the invention provides a method for treating fabrics.

BACKGROUND ART

Fragrance is an important attribute of many household products. It performs several functions, it can mask the odour of other ingredients within the product, it may reinforce claimed product attributes such as hygiene, softening or mildness and/or it may be functional, e.g. preserving the product, countering malodours or leaving a residual fragrance on a surface. In some household products, fragrance is considered sufficiently important that consumers may be offered several fragrance variants of a product, whilst for other products the choice of fragrance is more limited. However, consumers only experience the type and level of fragrance decided by the manufacturer. Consumers' attitudes to fragrance vary, with some people preferring to purchase un-fragranced products while others find the level of fragrance provided by many household products either to be too low, or that available fragrances are unattractive. Therefore, there is a need to offer consumers a choice as to the type and level of fragrance they choose to dose into various consumer products particularly those products which are dissolved in water before use, and to do so in a cost-effective manner.

Laundry detergent powders and solid fabric conditioners such as Henkel's Vernel™ Crystal are commercially available. However, these contain a predetermined amount of a specific fragrance and the only way the fragrance level can be changed is by adding more or less product. Procter and Gamble also sells a product under the name Un-Stoppables™ which is an additive consisting of free fragrance and encapsulated fragrance in a solid pellet of polyethylene glycol. EP 2 496 679 A1 (PTL 1) relates to products to freshen laundry comprising formulations consisting essentially of: from 80 to 91% by weight of polyethylene glycol, from 2 to 12% by weight of free fragrance, and from 2 to 12% by weight of friable fragrance microcapsules which comprise encapsulated fragrance. Other solid fragrance concentrates which can be used either directly in laundering fabrics or for addition to consumer products either during manufacture or for domestic use have been described in the patent literature.

For example, U.S. Pat. No. 4,209,417 A (PTL 2) describes fragranced particles having immediate and long lasting fragrance emitting properties consisting essentially of 30-70% of water-insoluble fragrance, 25-65% of a water-soluble polymer and an emulsifier, to be added to detergent products. However, these formulations are not compatible with product that has to be cast into a film and comminuted to powder.

EP 1 061 124 A (PTL 3) describes a substrate having prolonged fragrance, impregnated with a fragrance matrix containing a fragrance and a solid absorbent such as clays, combined with a fabric conditioner base. Such a product is limited to use in a laundry drier.

GB 1,549,432 A (PTL 4) relates to a fabric conditioning article for use in an automatic laundry dryer, said product comprising a mixture of free and encapsulated fragrance. The mixture is nevertheless affixed to an insoluble substrate which is not compatible with detergent products, and therefore cannot be added during a wash cycle.

WO 2004/105811 A1 (PTL 5) describes a volatile-containing composition comprising a carrier comprising at least one of the following: polyethylene glycol having a weight average molecular weight greater than or equal to 4,000, hydrogenated castor oil, fatty acids having a chain length greater than or equal to 14 carbon atoms, and at least one volatile material like a volatile fragrance or flavor, but not encapsulated fragrance.

US 2005/0227905 A1 (PTL 6) relates to a method for the production of a solid fragrance concentrate by mixing the fragrance with a molten fatty alcohol, alcohol ethoxylate or polyethylene glycol, absorbing the fragrance concentrate in a solid or solid mixture, and subsequently cooling the mixture. The products described comprise high proportions of fragrance without any encapsulated fragrance.

WO 02/26928 A1 (PTL 7) describes a water-soluble polymer composite comprising a chemically distinct species dispersed within the composite. The product is useful for the controlled release of additives in laundry and dishwashing application, but does not comprise encapsulated fragrance.

Fabric treatment compositions are described in U.S. Pat. No. 9,347,022 B1 (PTL 8) and WO 2016/078941 A1 (PTL 9).

CITATION LIST

Patent Literature

PTL 1: EP2496 679 A1
PTL 2: U.S. Pat. No. 4,209,417 A
PTL 3: EP 1 061 124 A
PTL 4: GB 1,549,432 A
PTL 5: WO 2004/105811 A1
PTL 6: US 2005/0227905 A1
PTL 7: WO 02/26928 A1
PTL 8: U.S. Pat. No. 9,347,022 B1
PTL 9: WO 2016/078941 A1

SUMMARY OF INVENTION

Technical Problem

The invention provides improved formulations compared with those of the prior art and which are more environmentally-friendly than those of EP 2 496 679 A1 (PTL 1) because of the use of a smaller proportion of polyethylene glycol. Indeed, the combination of a lower level of polyethylene glycol with a water-soluble salt and optionally an alkyl polyalkoxylate allows the processing and dissolution characteristics of the formulations to be adjusted for different markets. The formulations of the invention show controlled solubilisation speed in water compared to those of EP 2 496 679 A1 (PTL 1), and also permit agglomeration to be controlled, in particular in markets with higher ambient temperature. In addition, the formulations of the invention differ from many laundry products in that they do not fulfil any cleaning or fabric protection role in laundry beyond delivering fragrance which renders them complimentary to any laundry detergent, fabric softener or household cleaner. Depending on the nature of the wash, e.g. hand washing, machine washing using a front loading automatic or top loading machine, the product can be added to the wash at the most appropriate time. Besides, the solid compositions of the invention have the advantage of possibly comprising encapsulated fragrance contained in formaldehyde free microcapsules.

Solution to Problem

The present invention provides a solid composition, and in particular pellets, comprising polyethylene glycol, optional $C_8$-$C_{22}$-alkyl polyalkoxylate comprising at least 40 alkoxylate units, free fragrance, encapsulated fragrance, and an alkaline metal salt, alkaline earth metal salt or salt of an inorganic or $C_1$-$C_6$-alkyl organic acid, or a mixture thereof, which can be formulated to suit a variety of markets and wash habits.

The invention also relates to a method of making such solid composition, as well as to its use in home care products such as laundry products, fabric softeners or household cleaners.

Finally, the invention relates to a method of laundering fabrics comprising the step of adding the solid composition of the invention to fabrics at or before the start of a wash cycle or later during a wash cycle.

Advantageous Effects of Invention

In the present invention, it is possible to provide improved formulations compared with those of the prior art.

DESCRIPTION OF EMBODIMENTS

According to a first aspect, the invention relates to a solid composition comprising:

(a) from 30 to 65% by weight of polyethylene glycol, (b) from 0 to 40% by weight of a $C_8$-$C_{22}$-alkyl polyalkoxylate comprising at least 40 alkoxylate units, (c) from 0.5 to 15% by weight of free fragrance, (d) from 0.1 to 15% by weight of encapsulated fragrance, and (e) from 1 to 35% by weight of an alkaline metal salt, alkaline earth metal salt or salt of an inorganic or $C_1$-$C_6$-alkyl organic acid, or a mixture thereof.

In the sense of the invention, the weight of encapsulated fragrance means the weight of fragrance ingredients contained within microcapsules, such as core-shell microcapsules or matrix microcapsules. It corresponds to the weight of the sole fragrance ingredients, excluding the weight of the encapsulating material.

Polyethylene glycol (PEG) is a water-soluble polymer which may be formed into many different shapes and sizes. In the context of the invention, the PEG may be a single PEG or a mixture of two or more PEGs. The PEG comes in various molecular weights, and a suitable average molecular weight range of PEG for the purposes of freshening laundry varies from 4,000 to 100,000 mass units. Advantageously, the average molecular weight range of PEG varies from 4,000 to 50,000 mass units, more advantageously from 4.000 to 30,000 mass units, and even more advantageously from 4,000 to 25,000 mass units, from 4,000 to 20,000 mass units, from 4,000 to 15,000 mass units or from 4,000 to 10,000 mass units. PEG may be available from Dow Chemicals under the trade name Carbowax™, such as Carbowax™ 4600 or Carbowax™ 8000, from Croda under the trade name Renex™, such as Renex™ PEG 12.000 (INCI PEG 240) and Renex™ PEG 6,000 (INCI PEG 150), from Industria Chimica Panzeri under the trade name Polipan™, such as Polipan™ 4000 and Polipan™ 6000, and from BASF under the trade name Pluriol™, such as Pluriol™ E4000 and Pluriol™ E6000.

The composition of the invention comprises from 30 to 65%, and preferably from 40 to 60%, by weight of PEG to the total weight of the solid composition.

The alkyl alkoxylate of the invention is a $C_8$-$C_{22}$-alkyl polyalkoxylate comprising at least 40 alkoxylate units, which is solid at room temperature. Particularly preferred $C_8$-$C_{22}$-alkyl polyalkoxylate according to the invention are selected from the group consisting of polyoxyethylene fatty acid esters and ethoxylate fatty alcohols, and preferably from polyoxyethylene fatty acid esters and ethoxylate fatty alcohols comprising from 40 to 200 oxyethylene (OE) units.

Suitable polyoxyethylene fatty acid esters of the invention include STEROL ST/100 from Lamberti, Myrj™ S100 from Croda and MYS-55V from Nikkol.

Suitable ethoxylate fatty alcohols are known under the INCI names Steareth-50, Steareth-100 and Steareth-200, and are commercially available as Synperonic™ A50 and Brij™ 700 from Croda, or Genapol™ from BASF.

The composition of the invention comprises from 0 to 40%, preferably from 1 to 40%, and more preferably from 5 to 30%, by weight of $C_8$-$C_{22}$-alkyl polyalkoxylate to the total weight of the solid composition.

The solid composition of the invention comprises at least one free fragrance and at least one encapsulated fragrance contained within a microcapsule, prior to being mixed with the other ingredients of the formulation. Consequently, when the solid composition is shaped it will be possible to smell the free fragrance while the encapsulated fragrance will not be noticeable until a trigger effect occurs releasing it from the microcapsules. It can be appreciated that by separating the fragrances in this way the encapsulated fragrance may have a different fragrance note from the free fragrance. Therefore, it will be possible to offer consumers a change in fragrance triggered by some event which releases fragrance from the microcapsule. Depending on the trigger event, the release of encapsulated fragrance can be separated in time from the release of the free fragrance, which can be smelt continuously, even when smelling the product before use. The trigger effect may be dissolution in water; light exposure or heat generated for example by ironing; mechanical action; or pH change.

Within the solid composition, the weight ratio of free fragrance to encapsulated fragrance can be within the range from 1:30 to 150:1, preferably within the range from 1:10 to 100:3, and more preferably within the range from 1:3 to 30:1.

The composition of the invention comprises from 0.5 to 15%, preferably from 1 to 10%, more preferably from 1 to 8%, and even more preferably from 2 to 6%, by weight of free fragrance to the total weight of the solid composition.

According to the present invention, the term "fragrance", also named "fragrance ingredient", means a compound or any mixture of more than one compound which may also act as malodor counteractants. A wide variety of odiferous materials are known for perfumery use, including compounds such as alkenes, alcohols, aldehydes, ketones, esters, ethers, nitriles, amines, oximes, acetals, ketals, thiols, thioketones, imines, etc. Without limiting the scope of the invention, the ingredients of the fragrance composition will preferably have molecular weights of less than 325 atomic mass units, more preferably less than 300 mass units, and even more preferably less than 275 mass units, to ensure sufficient volatility to be noticeable. Furthermore, the fragrance ingredients will preferably have molecular weights greater than 100 mass units, more preferably greater than 120 mass units as lower masses may be too volatile or too water-soluble. The fragrance ingredients will not contain strongly ionizing functional groups such as sulphonates, sulphates, phosphates or quaternary ammonium ions.

Naturally occurring plant and animal oils, extracts, exudates and distillates, usually referred to as essential oils, comprise complex mixtures of various compounds and are also known for use as fragrance ingredients. Such ingredients can be used in the fragrances of the invention. Descriptions of many essential oils and methods of ex-traction and purification can be found in "The Essential Oils" by Ernest Guenther published by D. Van Nostrand in 1948, and may include extracts, pressings, the collection of exudates, and distillates from any part of suitable plants: roots, rhizomes, bulbs, corms, stem, bark, heartwood, leaves, flowers, seeds and fruit. Examples of such extracts and distillates include citrus fruit oils such as orange, mandarin, grapefruit, lime or lemon oils, tree oils such as pine, eucalyptus or cedarwood, herb oils such as peppermint, thyme, lavender, basil, rosemary, clove or flower extracts such as rose, jasmine, lily, or geranium oil. As is normal practise in fragrance formulation, the often complex mixtures that are essential oils will be considered as single ingredients when used in fragrances of the invention.

Fragrance compositions of the invention can be relatively simple in their composition with a minimum of two fragrance ingredients or can comprise highly complex mixtures of natural and synthetic compounds, chosen to provide any desired odour. It is preferred if the fragrance composition contains more than five ingredients, more preferable that they contain more than eight ingredients, and even more preferable that they contain more than twelve ingredients. Fragrance ingredients are described more fully in S. Arctander, Perfume Flavors and Chemicals, Vols. I and II, Montclair, N. J., in the Merck Index, $8^{th}$, Edition, Merck & Co., Inc. Rahway, N.J., and in Allured's FFM (Flavor and Fragrance Materials), all of which are incorporated herein by reference.

Advantageously, fragrance ingredients are selected from the following list.

$C_8$-$C_{18}$ hydrocarbons, preferably delta-3-carene, alpha-pinene, beta-pinene, alpha-terpinene, gamma-terpinene, p-cymene, bisabolene, camphene, caryophyllene, cedrene, farnesene, limonene, longifolene, myrcene, ocimene, valencene, and (E,Z)-1,3,5-undecatriene.

$C_2$-$C_{18}$ aliphatic alcohols, preferably hexanol, octanol, 3-octanol, 2,6-dimethylheptanol, 2-methylheptanol, 2-methyloctanol, (E)-3-hexenol, (E) and (Z)-3-hexenol, 1-octen-3-ol, mixtures of 3,4,5,6,6-pentamethyl-3/4-hepten-2-ol and 3,5,6,6-tetramethyl-4-methyleneheptan-2-ol, (E,Z)-2,6-nonadienol, 3,7-dimethyl-7-methoxyoctan-2-ol, 9-decenol, 10-undecenol, and 4-methyl-3-decen-5-ol.

$C_2$-$C_{18}$ aliphatic aldehydes and their acetals, preferably hexanal, heptanal, octanal, nonanal, decanal, undecanal, dodecanal, tridecanal, 2-methyloctanal, 2-methylnonanal, (E)-2-hexenal, (Z)-4-heptenal, 2,6-dimethyl-5-heptenal, 10-undecenal, (E)-4-decenal, 2-dodecenal, 2,6,10-trimethyl-5,9-undecadienal, heptanal diethyl acetal, 1,1-dimethoxy-2,2,5-trimethyl-4-hexene, and citronellyl oxyacetaldehyde.

$C_3$-$C_{18}$ aliphatic ketones and oximes thereof, preferably 2-heptanone, 2-octanone, 3-octanone, 2-nonanone, 5-methyl-3-heptanone, 5-methyl-3-heptanone oxime, and 2,4,4,7-tetramethyl-6-octen-3-one.

$C_2$-$C_{18}$ aliphatic sulphur-containing compounds, preferably 3-methylthiohexanol, 3-methylthiohexyl acetate, 3-mercaptohexanol, 3-mercaptohexyl acetate, 3-mercaptohexyl butyrate, 3-acetylthiohexyl acetate, and 1-menthene-8-thiol.

$C_2$-$C_{18}$ aliphatic nitrile-containing compounds, preferably 2-nonenenitrile, 2-tridecenenenitrile, 2,12-tridecenene-nitrile, 3,7-dimethyl-2,6-octadienenitrile, and 3,7-dimethyl-6-octenenitrile.

$C_2$-$C_{18}$ aliphatic carboxylic acids and esters thereof, preferably (E)- and (Z)-3-hexenyl formate, ethyl acetoacetate, isoamyl acetate, hexyl acetate, 3,5,5-trimethylhexyl acetate, 3-methyl-2-butenyl acetate, (E)-2-hexenyl acetate, (E)- and (Z)-3-hexenyl acetate, octyl acetate, 3-octyl acetate, 1-octen-3-yl acetate, ethyl butyrate, butyl butyrate, isoamyl butyrate, hexyl butyrate, (E)- and (Z)-3-hexenyl isobutyrate, hexyl crotonate, ethyl isovalerate, ethyl 2-methylpentanoate, ethyl hexanoate, allyl hexanoate, ethyl heptanoate, allyl heptanoate, ethyl octanoate, ethyl (E,Z)-2,4-decadienoate, methyl 2-octynoate, methyl 2-nonynoate, allyl-2-isoamyloxyacetate, and methyl-3,7-dimethyl-2,6-octadienoate.

$C_4$-$C_{18}$ acyclic terpene alcohols, preferably citronellol, geraniol, nerol, linalool, lavandulol, nerolidol, farnesol, tetrahydrolinalool, tetrahydrogeraniol. 2,6-dimethyl-7-octen-2-ol, 2,6-dimethyloctan-2-ol, 2-methyl-6-methylene-7-octen-2-ol, 2,6-dimethyl-5,7-octadien-2-ol, 2,6-dimethyl-3,5-octadien-2-ol, 3,7-dimethyl-4,6-octadien-3-ol, 3,7-dimethyl-1,5,7-octatrien-3-ol, and 2,6-dimethyl-2,5,7-octatrien-1-ol.

$C_4$-$C_{18}$ acyclic terpene aldehydes and ketones, preferably geranial, neral, citronellal, 7-hydroxy-3,7-dimethyloctanal, 7-methoxy-3,7-dimethyloctanal, 2,6,10-trimethyl-9-undecenal, geranylacetone, and the dimethyl and diethyl acetals of geranial, neral, and 7-hydroxy-3,7-dimethyloctanal.

$C_4$-$C_{18}$ cyclic terpene alcohols, preferably alpha-terpineol, terpineol-4, menthan-8-ol, menthan-1-ol, menthan-7-ol, borneol, isoborneol, linalool oxide, nopol, cedrol, ambrinol, vetiverol, and guaiol.

$C_4$-$C_{18}$ cyclic terpene aldehydes and ketones, preferably fenchone, alpha-ionone, beta-ionone, alpha-n-methylionone, bet-n-methylionone, alpha-isomethylionone, beta-isomethylionone, alpha-irone, alpha-damascone, beta-damascone, beta-damascenone, delta-damascone, gamma-damascone, 1-(2,4,4-trimethyl-2-cyclohexen-1-yl)-2-buten-1-one, 1,3,4,6,7,8a-hexahydro-1,1,5,5-tetramethyl-2H-2,4a-methanonaphthalen-8(5H)-one, nootkatone, dihydronootkatone, alpha-sinensal, beta-sinensal, and methyl cedryl ketone.

$C_4$-$C_{18}$ cyclic alcohols, preferably 4-tert-butylcyclohexanol, 3,3,5-trimethylcyclohexanol, 3-isocamphylcyclohexanol, 2,6,9-trimethyl-Z2,Z5,E9-cyclododecatrien-1-ol, and 2-isobutyl-4-methyltetrahydro-2H-pyran-4-ol.

$C_4$-$C_{18}$ cycloaliphatic alcohols, preferably alpha-3,3-trimethylcyclohexylmethanol, 2-methyl-4-(2,2,3-trimethyl-3-cyclopent-1-yl)butanol, 2-methyl-4-(2,2,3-trimethyl-3-cyclopent-1-yl)-2-buten-1-ol. 2-ethyl-4-(2,2,3-trimethyl-3-cyclopent-1-yl)-2-buten-1-ol, 3-methyl-5-(2,2,3-trimethyl-3-cyclopent-1-yl)-pentan-2-ol, 3-methyl-5-(2,2,3-trimethyl-3-cyclopent-1-yl)-4-penten-2-ol, 3,3-dimethyl-5-(2,2,3-trimethyl-3-cyclopent-1-yl)-4-penten-2-ol, 1-(2,2,6-trimethylcyclohexyl)pentan-3-ol, and 1-(2,2,6-trimethylcyclohexyl)hexan-3-ol.

$C_4$-$C_{18}$ cyclic and cycloaliphatic ethers, preferably cedryl methyl ether, cyclododecyl methyl ether, (ethoxymethoxy) cyclododecane, alpha-cedrene epoxide, 3a,6,6,9a-tetramethyl-dodecahydronaphtho[2,1-b]furan, 3a-ethyl-6,6,9a-trimethyldodecahydro-naphtho[2,1-b]furan, 1,5,9-trimethyl-13-oxabicyclo[10.1.0]trideca-4,8-diene, rose oxide, and 2-(2,4-dimethyl-3-cyclohexen-1-yl)-5-methyl-5-(1-methylpropyl)-1,3-dioxane.

$C_4$-$C_{18}$ cyclic ketones, preferably 4-tert-butylcyclohexanone, 2,2,5-trimethyl-5-pentylcyclopentanone, 2-heptylcyclopentanone, 2-pentylcyclopentanone, 2-hydroxy-3-methyl-2-cyclopenten-1-one, 3-methyl-cis-2-penten-1-yl-2-cyclopenten-1-one, 3-methyl-2-pentyl-2-cyclopenten-1-one, 3-methyl-4-cyclopentadecenone, 3-methyl-5-cyclopentadecenone, 3-methylcyclopentadecanone, 4-(1-ethoxyvinyl)-3,3,5,5-tetramethylcyclohexanone, 4-tert-pentylcyclohexanone, 5-cyclohexadecen-1-one, 6,7-dihydro-1,1,2,3,3-pentamethyl-4(5H)-indanone, 9-cycloheptadecen-1-one, cyclopentadecanone, and cyclohexadecanone.

$C_4$-$C_{18}$ cycloaliphatic aldehydes, preferably 2,4-dimethyl-3-cyclohexenecarbaldehyde, 2-methyl-4-(2,2,6-trimethyl-cyclohexen-1-yl)-2-butenal, 4-(4-hydroxy-4-methylpentyl)-3-cyclohexenecarbaldehyde, and 4-(4-methyl-3-penten-1-yl)-3-cyclohexenecarbaldehyde.

$C_4$-$C_{18}$ cycloaliphatic ketones, preferably 1-(3,3-dimethylcyclohexyl)-4-penten-1-one, 1-(5,5-dimethyl-1-cyclohexen-1-yl)-4-penten-1-one, 2,3,8,8-tetramethyl-1,2,3,4,5,6,7,8-octahydro-2-naphthalenyl methyl ketone, methyl-2,6,10-trimethyl-2,5,9-cyclododecatrienyl ketone, and tert-butyl (2,4-dimethyl-3-cyclohexen-1-yl)ketone.

Esters of cyclic alcohols in $C_4$-$C_{18}$, preferably 2-tert-butylcyclohexyl acetate, 4-tert-butyl-cyclohexyl acetate, 2-tert-pentylcyclohexyl acetate, 4-tert-pentylcyclohexyl acetate, decahydro-2-naphthyl acetate, 3-pentyltetrahydro-2H-pyran-4-yl acetate, decahydro-2,5,5,8a-tetramethyl-2-naphthyl acetate, 4,7-methano-3a,4,5,6,7,7a-hexahydro-5 or 6-indenyl acetate, 4,7-methano-3a,4,5,6,7,7a-hexahydro-5 or 6-indenyl propionate, 4,7-methano-3a,4,5,6,7,7a-hexahydro-5 or 6-indenyl isobutyrate, and 4,7-methanooctahydro-5 or 6-indenyl acetate.

Esters of cycloaliphatic carboxylic acids in $C_4$-$C_{18}$, preferably allyl 3-cyclohexylpropionate, allyl cyclohexyloxyacetate, methyl dihydrojasmonate, methyl jasmonate, methyl 2-hexyl-3-oxocyclopentanecarboxylate, ethyl 2-ethyl-6,6-dimethyl-2-cyclohexenecarboxylate, ethyl 2,3,6,6-tetramethyl-2-cyclohexenecarboxylate, and ethyl 2-methyl-1,3-dioxolane-2-acetate.

$C_4$-$C_{18}$ aromatic hydrocarbons, preferably styrene and diphenylmethane.

$C_4$-$C_{18}$ araliphatic alcohols, preferably benzyl alcohol, 1-phenylethyl alcohol, 2-phenylethyl alcohol, 3-phenylpropanol, 2-phenylpropanol, 2-phenoxyethanol, 2,2-dimethyl-3-phenylpropanol, 2,2-dimethyl-3-(3-methylphenyl)propanol, 1,1-dimethyl-2-phenylethyl alcohol, 1,1-dimethyl-3-phenylpropanol, 1-ethyl-1-methyl-3-phenylpropanol, 2-methyl-5-phenylpentanol, 3-methyl-5-phenylpentanol, 3-phenyl-2-propen-1-ol, 4-methoxybenzyl alcohol, and 1-(4-isopropylphenyl)ethanol.

Esters of araliphatic alcohols in $C_4$-$C_{18}$ and aliphatic carboxylic acids in $C_4$-$C_{18}$, preferably benzyl acetate, benzyl propionate, benzyl isobutyrate, benzyl isovalerate. 2-phenylethyl acetate, 2-phenylethyl propionate, 2-phenylethyl isobutyrate, 2-phenylethyl isovalerate, 1-phenylethyl acetate, alpha-trichloromethylbenzyl acetate, alpha,alpha-dimethylphenylethyl acetate, alpha,alpha-dimethylphenylethyl butyrate, cinnamyl acetate. 2-phenoxyethyl isobutyrate, and 4-methoxybenzyl acetate.

$C_2$-$C_{18}$ araliphatic ethers, preferably 2-phenylethyl methyl ether, 2-phenylethyl isoamyl ether, 2-phenylethyl 1-ethoxyethyl ether, phenylacetaldehyde dimethyl acetal, phenylacetaldehyde diethyl acetal, hydratropaldehyde dimethyl acetal, phenylacetaldehyde glycerol acetal, 2,4,6-trimethyl-4-phenyl-1,3-dioxane, 4,4a,5,9b-tetrahydroindeno[1,2-d]-m-dioxin, and 4,4a,5,9b-tetrahydro-2,4-dimethylindeno[1,2-d]-m-dioxin.

$C_4$-$C_{18}$ aromatic and araliphatic aldehydes, preferably benzaldehyde, phenylacetaldehyde, 3-phenylpropanal, hydratropaldehyde, 4-methylbenzaldehyde, 4-methylphenylacetaldehyde, 3-(4-ethylphenyl)-2,2-dimethylpropanal, 2-methyl-3-(4-isopropylphenyl)propanal, 2-methyl-3-(4-tert-butylphenyl)propanal, 3-(4-tert-butylphenyl)propanal, cinnamaldehyde, alpha-butylcinnamaldehyde, alpha-amylcinnamaldehyde, alpha-hexylcinnamaldehyde, 3-methyl-5-phenylpentanal, 4-methoxybenzaldehyde, 4-hydroxy-3-methoxybenzaldehyde, 4-hydroxy-3-ethoxybenzaldehyde, 3,4-methylenedioxybenzaldehyde, 3,4-dimethoxybenzaldehyde, 2-methyl-3-(4-methoxyphenyl)propanal, and 2-methyl-3-(4-methylenedioxyphenyl)propanal.

$C_4$-$C_{18}$ aromatic and araliphatic ketones, preferably acetophenone, 4-methylacetophenone, 4-methoxyacetophenone, 4-tert-butyl-2,6-dimethylacetophenone, 4-phenyl-2-butanone, 4-(4-hydroxyphenyl)-2-butanone, 1-(2-naphthalenyl)ethanone, benzophenone, 1,1,2,3,3,6-hexamethyl-5-indanyl methyl ketone, 6-tert-butyl-1,1-dimethyl-4-indanyl methyl ketone, 1-[2,3-dihydro-1,1,2,6-tetramethyl-3-(1-methylethyl)-1H-5-indenyl]ethanone, and 5',6',7',8'-tetrahydro-3',5',5',6',8',8'-hexamethyl-2-acetonaphthone.

$C_4$-$C_{18}$ aromatic and araliphatic carboxylic acids and esters thereof, preferably phenylacetic acid, methyl benzoate, ethyl benzoate, hexyl benzoate, benzyl benzoate, methyl phenylacetate, ethyl phenylacetate, geranyl phenylacetate, phenylethyl phenylacetate, methyl cinnamate, ethyl cinnamate, benzyl cinnamate, phenylethyl cinnamate, cinnamyl cinnamate, allyl phenoxyacetate, methyl salicylate, isoamyl salicylate, hexyl salicylate, cyclohexyl salicylate, cis-3-hexenyl salicylate, benzyl salicylate, phenylethyl salicylate, methyl 2,4-dihydroxy-3,6-dimethylbenzoate, ethyl 3-phenylglycidate, and ethyl 3-methyl-3-phenylglycidate.

Nitrogen-containing aromatic compounds in $C_4$-$C_{18}$, preferably 2,4,6-trinitro-1,3-dimethyl-5-tert-butylbenzene, 3,5-dinitro-2,6-dimethyl-4-tert-butylacetophenone, cinnamonitrile, 5-phenyl-3-methyl-2-pentenenitrile, 5-phenyl-3-methylpentanenitrile, methyl anthranilate, methyl N-methylanthranilate, Schiff bases of methyl anthranilate with 7-hydroxy-3,7-dimethyloctanal, 2-methyl-3-(4-tert-butylphenyl)propanal, 2,4-dimethyl-3-cyclohexene-carbaldehyde, 6-isopropylquinoline, 6-isobutylquinoline, 6-sec-butylquinoline, indole, skatole, 2-methoxy-3-isopropylpyrazine, and 2-isobutyl-3-methoxypyrazine.

Phenols, phenyl ethers and phenyl esters, preferably estragole, anethole, eugenol, eugenyl methyl ether, isoeugenol, isoeugenyl methyl ether, thymol, carvacrol, diphenyl ether, beta-naphthyl methyl ether, beta-naphthyl ethyl ether, beta-naphthyl isobutyl ether, 1,4-dimethoxybenzene, eugenyl acetate, 2-methoxy-4-methylphenol, 2-ethoxy-5-(1-propenyl)phenol, and p-cresyl phenylacetate.

Heterocyclic compounds in $C_4$-$C_{12}$, preferably 2,5-dimethyl-4-hydroxy-2H-furan-3-one, 2-ethyl-4-hydroxy-5-methyl-2H-furan-3-one, 3-hydroxy-2-methyl-4H-pyran-4-one, and 2-ethyl-3-hydroxy-4H-pyran-4-one.

Lactones in $C_4$-$C_{12}$, preferably 1,4-octanolide, 3-methyl-1,4-octanolide, 1,4-nonanolide, 1,4-decanolide, 8-decen-1,4-olide, 1,4-undecanolide, 1,4-dodecanolide, 1,5-decanolide, 1,5-dodecanolide, 1,15-pentadecanolide, cis and trans-11-pentadecen-1,15-olide, cis- and trans-12-pentadecen-1,15-olide, 1,16-hexadecanolide, 9-hexadecen-1,16-olide, 10-oxa-1,16-hexadecanolide, 11-oxa-1,16-hexadecanolide, 12-oxa-1,16-hexadecanolide, ethylene 1,12-dodecanedioate, ethylene 1,13-tridecanedioate, coumarin, 2,3-dihydrocoumarin, and octahydrocoumarin.

The free fragrance may comprise at least 50%, preferably at least 60%, more preferably at least 70%, and even more preferably at least 80%, by weight of fragrance ingredients having a C log P from 3.30 to 6.50, and preferably having a C log P from 3.50 to 6.00. C log P refers to the octanol/water partitioning coefficient (P) of fragrance ingredients. The octanol/water partitioning coefficient of a fragrance ingredient is the ratio between its equilibrium concentrations in octanol and in water. The partitioning coefficients of fragrance ingredients are more conveniently given in the form of their logarithm to the base 10 (log P). The measured log P values of many fragrance ingredients have been reported; for example, the Pomona92 database, available from Daylight Chemical Information Systems, Inc. (Daylight CIS), Irvine, Calif., contains many, along with citations to the original literature. However, the C log P values reported herein are most conveniently calculated by the <<CLOGP>> program available within the program ChemBioOffice 14 Ultra Edition v14.0.0.117 supplied by Perkin Elmer Inc. of Waltham Ma. USA. The C log P values are preferably used instead of the experimental log P values in the selection of fragrance ingredients which are useful in the present invention to avoid variations in measurement or between different calculation algorithms. For natural oils or extracts the composition of such oils can be determined by analysis or using the compositions published in the ESO 2000 database published by BACIS (Boelens Aroma Chemical Information Service. Groen van Prin-sterlaan 21, 1272 GB Huizen, The Netherlands).

Some examples of fragrance ingredients and their C log P values are given in Table 1 below.

TABLE 1

ClogP values of fragrance ingredients

| Ingredient | CAS number | ClogP |
|---|---|---|
| d-Limonene | 5989-27-5 | 4.35 |
| Isobutyl quinoline | 93-19-6 | 3.98 |
| Hexyl cinnamic aldehyde | 101-86-0 | 5.00 |
| Lilial | 80-54-6 | 4.10 |
| Galaxolide | 1222-05-5 | 5.74 |
| Cyclamen aldehyde | 103-95-7 | 3.83 |
| Isobornyl acetate | 125-12-2 | 4.04 |
| Carvacrol | 499-75-2 | 3.35 |
| Para cymene | 99-87-6 | 4.07 |
| Geranyl acetate | 105-87-3 | 3.91 |
| Linalyl acetate | 115-95-7 | 3.70 |
| Vertenex | 32210-23-4 | 4.06 |

According to one embodiment, the composition of the invention comprises from 0.1 to 15%, preferably from 0.3 to 10%, and more preferably from 0.5 to 6%, by weight of encapsulated fragrance to the total weight of the solid composition.

The encapsulated fragrance of the invention is contained in microcapsules, and preferably in core-shell microcapsules or matrix microcapsules. The term "microcapsule" is used herein in a broad sense for particles in which fragrance is trapped and can be dispersed and prevented from mixing with the free fragrance present in the solid composition.

A description of the different types of microcapsules, methods of preparation and encapsulating materials can be found in the Encyclopedia of Chemical Technology (Kirk Othmer Encyclopedia of Technology, 4$^{th}$ edition, published in 1995 by John Wiley & Sons, Vol. 16, pages 628-651) and MICROENCAPSULATION: Methods and Industrial Applications Edited by Benita and Simon (Marcel Dekker, Inc. 1996). A preferred type of microcapsule is termed a core-shell microcapsule. Core-shell microcapsules typically comprise a spherical hollow shell of water-insoluble or at least partially water-insoluble material, typically polymer material, within which the fragrance and other material is contained. Examples of microcapsules according to the invention are described in the following references: US 2003/215417; US 2003/216488; US 2003/165692; US 2004/071742; US 2004/071746; US 2004/072719; US 2004/072720; EP 1 393 706; US 2003/203829; US 2003/195133; US 2004/087477; US 2004/0106536; U.S. Pat. Nos. 6,200,949; 4,882,220; 4,917,920; 4,514,461; US RE 32,713; U.S. Pat. Nos. 4,234,627; 3,516,941, 4,520,142; 4,528,226, 4,681,806; 4,145,184; GB 2,073,132; and WO 99/17871.

According to another embodiment, the encapsulated fragrance is contained in more than one type of microcapsule.

According to another preferred embodiment, the encapsulated fragrance is contained in microcapsules that are friable. Friability refers to the propensity of the microcapsules to rupture or break open when subjected to direct external pressures or shear forces. For purposes of the present invention, the microcapsules are "friable" if, while attached to fabrics treated therewith, they can be ruptured by the forces encountered when the microcapsule-containing fabrics are manipulated by being worn or handled (thereby releasing the contents of the microcapsule).

The encapsulated fragrance may be contained in microcapsules which are moisture-activated matrix microcapsules, such as those described in U.S. Pat. No. 5,246,603 made of starch or modified starches that release upon contact with water.

The encapsulated fragrance may be contained in microcapsules which are formed by coacervation techniques, as described in the following patents: U.S. Pat. Nos. 2,800,458; 3,159,585; 3,533,958; 3,697,437; 3,888,689; 3,996,156; 3,965,033; 4,010,038; and 4,016,098. The preferred encapsulating material is gelatin coacervated with a polyanion such as gum arabic, and more preferably cross-linked with a cross-linking material such as glutaraldehyde or alginates co-acervated with calcium ions.

According to a preferred embodiment, the encapsulated fragrance is contained in microcapsules which are prepared by methods known to those skilled in the art:

- by polymerising vinyl monomers with cross-linking agents, as described in U.S. Pat. Nos. 9,221,028; 9,162,085; 6,849,591; 6,951,836; WO 2010/119020; EP 2 832 440; EP 2 832 441; and EP 2 832 442;
- by a condensation reaction: a common condensation reaction for manufacturing microcapsules involves reacting a polyamine usually melamine or a phenolic compound with an aldehyde which is usually formaldehyde. The resultant microcapsule not only contains some residual formaldehyde but under some conditions the condensation reaction may reverse releasing more formaldehyde. Examples of patent applications which describe preparing capsules with aldehydes other than formaldehyde by a condensation reaction include WO 2011/110368 and WO 2011/161618;
- by interfacial polymerisation which occurs when reagents are separated between the dispersed and continuous phases. One reagent is dissolved in the oil in the disperse phase and after the emulsion is formed a second reagent is added into the continuous, usually aqueous phase. One of the reagents must be at least difunctional in order to create a polymer. Typically, reactions occur between isocyanates in the oil phase and water-soluble polyamines added to the aqueous phase. Examples of fragrance capsules made by such methods are given in WO 2011/161229 and WO 2012/107323.

According to a preferred embodiment, the encapsulated fragrance is contained in microcapsules which are formaldehyde free. In the sense of the invention, formaldehyde free means that no formaldehyde, nor compounds which can generate formaldehyde by chemical reactions such as hydrolysis, is used to prepare the microcapsules.

Those skilled in capsule manufacture will appreciate that there are many variations which may be introduced into the manufacture of microcapsules such as varying ingredient proportions and/or process parameters but which still fall within the general description for microcapsules preparation as described in the cited references.

According to a more preferred embodiment, the encapsulated fragrance of the invention is contained in microcapsules which are formaldehyde free and are made by polymerizing vinyl monomers with cross-linking agents.

Typically, the encapsulated fragrance comprises microcapsules which have an average particle size as median volume particle size D(v; 0.5) value from 1 to 500 μm, preferably from 5 to 200 μm, more preferably from 5 to 100 μm, and even more preferably from 5 to 50 μm. For both matrix microcapsules and core-shell microcapsules, the preferred technique to measure the microcapsule average particle size is light scattering using for example a Horiba (registered trademark) or a Malvern (registered trademark) Laser scattering particle Size Distribution analyzer or an equivalent instrument working on the principle of low angle laser light scattering (LALLS). The general guidelines set out in ISO 13320 "Particle Size Analysis—Laser Diffraction Methods" (2009 edition) may be followed.

The particle size distribution of the microcapsules can be narrow, broad or multimodal.

Advantageously, when the encapsulated fragrance is contained in core-shell microcapsules, the encapsulated fragrance comprises at least 50% by weight, preferably 60%, more preferably 70%, even more preferably 80%, and still even more preferably 90%, by weight of one or more bulky fragrance molecules. Bulky fragrance molecules of the invention are as disclosed in EP 1 894 603, which is incorporated herein by reference, and are mixtures of molecules which by virtue of the arrangement of atoms or conformational rigidity are too bulky or inflexible to pass readily through the walls of the microcapsule. Considering a molecule's possible conformations in three di-mensions, the ratio of length to width and depth must be such that irrespective of the orientation of the molecule it will not pass through the walls of the microcapsule.

The bulky fragrance molecules may be selected from the group consisting of the following ingredients.

Ingredient: CAS Number
amboryl acetate: 059056-62-1
Ambrox™ DL: 003738-00-9
acetoketal: 005406-58-6
Ambrinol™: 041199-19-3
acetyl eugenol: 93-28-7
acetyl vanillin: 881-68-5
amber Core™: 139504-68-0
Ambretone™: 37609-25-9
Ambrettolide™: 28645-51-4
anisyl acetate: 104-21-2
Bacdanol™: 28219-61-6
benzyl dimethyl carbinyl acetate: 151-05-3
beta-homocyclocitral: 472-66-2
boronal: 3155-71-3
Brahmanol™: 72089-08-8
benzophenone: 000119-61-9
benzyl salicylate: 000118-58-1
benzyl eugenol: 057371-42-3
benzyl cinnamate: 000103-41-3
borneol, L: 000464-45-9
bornyl acetate: 000076-49-3
bourgeonal: 18127-01-0
Calone™: 28940-11-6
Cetalox™: 003738-00-9
Celestolide™: 013171-00-1
camphene: 000079-92-5
camphor gum powder synthetic: 000076-22-2
cyclohexyl salicylate: 025485-88-5
Cyclaprop™: 017511-60-3
Cyclabute™: 067634-20-2
Cyclacet™: 005413-60-5
coumarin: 000091-64-5
cinnamyl cinnamate: 000122-69-0
caryophyllene, beta: 000087-44-5
caryophyllene: 000087-44-5
caryophyllene acetate: 057082-24-3
cedramber: 019870-74-7
alpha cedrene: 469-61-4
cedrenyl acetate: 1405-92-1
cedryl acetate: 000077-54-3
cedryl meth ether: 019870-74-7
cedryl formate: 039900-38-4
cineol, 1,8: 000470-82-6
cineol 1,4: 000470-67-7
Cashmeran™: 033704-61-9
cedanol: 007070-15-7
alpha copaene: 3856-25-5
cyclohexyl anthranilate: 7779-16-0
2-cyclohexylidene-2-phenylacetonitrile: 10461-98-0
cinnamyl phenyl acetate: 7492-65-1
Cedroxyde™: 71735-79-0
celery ketone: 3720-16-9
civettone: 542-46-1
clarycet: 131766-73-9
coniferan: 67874-72-0
delta-damascone: 57378-68-4
damascol 4: 4927-36-0
delta-muscenone: 82356-51-2
dihydrofloralol: 68480-15-9
dihydrojasmone: 1128-08-1
dynascone: 56973-85-4
alpha-damascone: 24720-09-0
gamma-damascone: 35087-49-1
decahydro beta naphthyl acetate, trans: 010519-11-6
Doremox™: 094201-73-7
diphenyl oxide: 000101-84-8
dibenzyl ketone: 000102-04-5
Dulcinyl™: 055418-52-5
Ebanol™: 67801-20-1
Exaltolide™: 106-02-5
Exaltone™: 502-72-7
Florasantol™: 067739-11-1
fenchyl alcohol: 001632-73-1
florex: 069486-14-2
Fruitate™: 080657-64-3
fenchol: 22627-95-8
fenchyl acetate: 13851-11-1

Floramat™: 67801-64-3
Fraistone™: 6290-17-1
Galaxolide™: 001222-05-5
grisalva: 068611-23-4
Globalide™: 34902-57-3
green acetate: 88-41-5
Heliobouquet™: 001205-17-0
Spirodecane™: 6413-26-9
Hedione™: 24851-98-7
isocyclogeraniol: 68527-77-5
iso cyclocitral: 1335-66-6
iso borneol: 000124-76-5
iso bornyl acetate: 000125-12-2
isobornyl formate: 1200-67-5
isobornyl methyl ether: 5331-32-8
iso E Super™: 054464-57-2
isobornyl propionate: 002756-56-1
isoproxen: 090530-04-4
isolongifolanone: 014727-47-0
isobutyl quinoline: 065442-31-1
indolene: 068908-82-7
gamma-ionone: 79-76-5
alpha-ionone: 127-41-3
dihydro-iso-jasmonate: 37172-53-5
Jasmelia™: 58285-49-3
Karanal™: 117933-89-8
Kephalis™: 36306-87-3
Levosandol™: 28219-61-6
Lilial™: 80-54-6
Lyrame™: 067634-12-2
alpha-isomethyl ionone: 1335-46-9
methyl naphthyl ketone crystals: 000093-08-3
methyl laitone: 94201-19-1
methyl dioxolan: 06413-10-1
methyl jasmonate: 1211-29-6
muscone: 541-91-3
musk ambrette: 83-66-9
ethylene brassylate: 105-95-3
musk thibetene: 145-39-1
nerolin: 93-18-5
naphthol isobutyl ether, beta: 002173-57-1
nootkatone 98%: 004674-50-4
neoproxen: 122795-41-9
(12R,9Z)-Nirvanolide™: 22103-61-8
nopol: 128-50-7
nopyl acetate: 35836-72-7
Okoumal™: 131812-67-4
Orriniff™: 125352-06-9
Orivone™: 16587-71-6
palisandin: 2986-54-1
pinene, alpha: 000080-56-8
pinene, beta: 000127-91-3
phenyl ethyl phenyl acetate: 000102-20-5
Phantolid™: 015323-35-0
Plicatonet™: 041724-19-0
patchone: 98-52-2
patchouly ketone: 98-53-3
piperonyl acetate: 326-61-4
Polysantol™: 107898-54-4
precyclemone B: 52474-60-9
Romascone™: 81752-87-6
Rhubofix™: 041816-03-9
sandalmysore Core™: 28219-60-5
Sandalore™: 65113-99-7
santalex T™: 068877-29-2
Scentenal™: 086803-90-9
Spirambrene™: 12151-67-0 and 12151-68-1
Tonalid™: 021145-77-7
Traseolide™: 068140-48-7
thymoxane: 707-29-9
Timberol™: 70788-30-6
trimofix O™: 28371-99-5
vanillin propylene glycol acetal: 068527-74-2
Vigoflor™: 068480-11-5
Verdol™: 13491-79-7
veloutone: 65443-14-3
veratraldehyde: 120-14-9
veratricacid: 93-07-2
Vertenex™: 32210-23-4
Violiff™: 87731-18-8
yara yara: 000093-04-9

A wide range of typical fragrance solvents, both hydrophobic and hydrophilic, such as dipropylene glycol, tri-ethyl citrate, benzyl benzoate, glycol ethers (e.g. Dowanol™ range), dicarboxylic dimethylesters (e.g. Flexisolve™), glycerine derivatives such as 1,2-isopropylideneglycerol sold under the trade name Augeo™ Clean Multi, and isopropyl myristate can be used as part of the free fragrance. For the encapsulated fragrance contained within microcapsules, hydrophobic fragrance solvents (having C log P>4) are preferable, such as iso-propyl myristate, and the level of hydrophilic fragrance solvents should be minimised, and if possible their use should be avoided.

Optional benefit agents may also be added to the solid composition of the invention. They may be combined with either the free fragrance or the encapsulated fragrance. Said benefit agents can be selected from the group consisting of:

- relaxants or stimulants, such as natural oils or plant extracts which are beneficial to skin, like jojoba oil and almond oil,
- agents which provide a warming or cooling effect such as described in Cosmetics and Toiletries of by E. Erman, Vol. 120, No. 5, p. 105. Examples of such agents include but are not limited to: cyclohexane carboxamide N-ethyl-5-methyl-2-(1-methylethyl) known as WS3™ (CAS number 39711-79-0), N-2,3-trimethyl-2-isopropylbutamide known as WS23™ (CAS number 51115-67-4), menthyl lactate (CAS number 59259-38-0); isopulegol known as Coolact PT™ and (–)-menthoxypropane-1,2-diol known as Coolact (registered trademark) 10,
- insect repellents such as ethylbutylacetylaminopropionate known as Merck's IR3535™ (CAS number 52304-36-6), N,N-diethyl-m-toluamide (CAS number 134-62-3); 1-piperidinecarboxylic acid, 2-(2-hydroxyethyl)-1-methylpropyl ester known as Bayrepel™ (CAS number 119515-38-7), p-menthane-3,8-diol (CAS number 42822-86-6), Tea Tree oil, neem oil, citronella oil and eucalyptus oil,
- antimicrobial agents such as Triclosan™ (CAS number 3380-34-5), methyl, ethyl, propyl and butyl-para-hydroxybenzoate esters (CAS number 4247-02-3, 94-26-8, 94-13-3, 120-47-8 and 99-76-3),
- UV absorbers such as octyl methoxycinnamate, benzophenone-3, butylmethoxy-dibenzoylmethane and bis-ethylhexyloxyphenolmethoxyphenyltriazine, and
- their mixtures.

The solid composition of the invention also comprises one or more alkaline metal salt(s), alkaline earth metal salt(s) or salt(s) of an inorganic or $C_1$-$C_6$-alkyl organic acid.

The alkaline metal salt, alkaline earth metal salt or salt of an inorganic or $C_1$-$C_6$ organic acid of the invention may be a sodium, potassium, calcium or ammonium salt of an inorganic or $C_1$-$C_6$-alkyl organic acid, and possibly partially neutralised salts of such sodium, potassium, calcium or ammonium salts of an inorganic or $C_1$-$C_6$-alkyl organic acid. The alkaline metal salt, alkaline earth metal salt or salt of an inorganic or $C_1$-$C_6$ organic acid of the invention may include any and all anhydrous or hydrated crystalline forms.

The alkaline metal salt, alkaline earth metal salt or salt of an inorganic or $C_1$-$C_6$-alkyl organic acid of the invention may have a density below 2750 $kg \cdot m^{-3}$ and a particle size below 250 μm, and preferably below 200 μm, which by virtue of this combination of density and particle size can be suspended in a molten mixture of polyethylene glycol, optional $C_8$-$C_{22}$-alkyl polyalkoxylate, free fragrance and encapsulated fragrance, as defined according to the present invention, during processing.

The densities of some alkaline metal salts, alkaline earth metal salts or salts of inorganic or $C_1$-$C_6$-alkyl organic acids are reported below (excerpt from Tables of Physical & Chemical Constants, $16^{th}$ edition, 1995 by Kaye & Laby Online, Version 1.0).

Compound: Density ($kg \cdot m^{-3}$)
sodium acetate: 1528
sodium carbonate decahydrate: 1440/15
sodium carbonate (anhydrous): 2532
sodium chloride: 2465/25
sodium citrate dihydrate: 1700
sodium dihydrogen phosphate hydrate: 2040
sodium bicarbonate: 2159
disodium hydrogen phosphate dodecahydrate: 1520
sodium bisulphate: 2435
sodium nitrate: 2261
sodium sulphate decahydrate: 1463
sodium sulphate (anhydrous): 2680
potassium acetate: 1570
potassium carbonate: 2428
potassium chloride: 1984
potassium citrate monohydrate: 1980
potassium bicarbonate: 2170
potassium sulphate: 2662
ammonium chloride: 1527
ammonium nitrate: 1725
ammonium sulphate: 1769/50
calcium chloride hexahydrate: 1710/25
calcium chloride (anhydrous): 2150

The sodium, potassium, calcium or ammonium salt of an inorganic acid of the invention may be selected from sodium, potassium, calcium or ammonium salts of hydrochloric, nitric, phosphoric, sulfuric or carbonic acid, or mixture thereof, and preferably is sodium bicarbonate or sodium chloride. The sodium, potassium, calcium or ammonium salt of $C_1$-$C_6$-alkyl, preferably $C_2$-$C_6$, organic acid of the invention, may be selected from sodium, potassium, calcium or ammonium salts of acetic, propionic, lactic, citric or succinic acid, or mixture thereof, and preferably is sodium acetate or sodium citrate. The sodium, potassium, calcium or ammonium salt of an inorganic or $C_1$-$C_6$-alkyl organic acid may include partially neutralised salts such as monosodium dihydrogen phosphate or sodium dihydrogen citrate.

The alkaline metal salt, alkaline earth metal salt or salt of an inorganic or $C_1$-$C_6$-alkyl organic acid of the invention is advantageously selected from sodium bicarbonate, sodium chloride, sodium acetate and sodium citrate.

The solid composition of the invention comprises from 1 to 35%, preferably from 5 to 35%, and more preferably from 10 to 35%, by weight of said alkaline metal salt, alkaline earth metal salt or salt of an inorganic or $C_1$-$C_6$-alkyl organic acid, or mixture thereof, to the weight of the solid composition.

The solid composition of the invention may also comprise one or more ingredients which improve the visual aesthetics of the final product. Such ingredient may include colorants, whitening agents such as titanium dioxide, fluorescent agents and pearlising agents. If one or more colorants are added to the solid composition of the invention they may represent from 0 to 0.50%, more preferably from 0 to 0.10%, and even more preferably from 0 to 0.05%, by weight of the solid composition.

The colorant may be selected from those commonly used in fabric softeners and liquid detergents such as water-soluble polymeric colorants. Examples may be found in the Liquitint range of water-soluble dyes commercialized by Milliken, such as Blue HP; OrcoTerge™ and OrcoTint™ dyes commercialized by Organic Dyes and Pigment LLC; or the Chromatint dyes available from Chromatech Europe B.V.

In one aspect, the solid composition of the invention is in the form of powder, flakes or pellets, and preferably in the form of pellets. The average particle size of the powder may range from 100 to 1000 μm, and preferably from 250 to 700 μm, and may be determined by techniques such as sieve analysis. The term "pellet" includes spherical, hemispherical, cylindrical, square and rectangular shapes. The pellets can be formed using traditional pelletizer equipment, such as sold by Sandvik, by extrusion processes or by spray chilling. The pellets have preferably an average weight ranging from 1 mg/pellet to 1 g/pellet, preferably from 20 to 250 mg/pellet, and more preferably from 20 to 100 mg/pellet. The average length of the pellets may range from 0.5 to 30 mm, preferably 0.75 to 30 mm, more preferably 0.8 to 10 mm, and even more preferably 2 to 7.5 mm, and may be measured for example with an optical microscope linked to an image analysing software such as Malvern Morphologi.

Therefore, according to a second aspect, the invention provides a method of making a solid composition as defined according to the invention, in the form of pellets, said method using known technologies of forming pellets by melting the components to a moderate viscosity mixture, and then pelletizing the mixture by methods well-known in the art, such as casting a film which is comminuted on solidifying, dispensing drops onto a cool surface to form pellets or spray chilling.

The method of making the solid composition as defined according to the invention, in the form of pellets, may comprise the steps of:

(i) mixing polyethylene glycol(s) and an optional $C_8$-$C_{22}$-alkyl polyalkoxylate comprising at least 40 alkoxylate units, (ii) melting the mixture obtained at the end of step (i) at a temperature higher than the melting points of the polyethylene glycol(s) and the optional $C_8$-$C_{22}$-alkyl polyalkoxylate comprising at least 40 alkoxylate units, (iii) adding to the mixture obtained at the end of step (ii) a free fragrance, an encapsulated fragrance, and an alkaline metal salt, alkaline earth metal salt or salt of an inorganic or $C_1$-$C_6$-alkyl organic salt or a mixture thereof, in any order, (iv) mixing the mixture obtained at the end of step (iii) to form a uniform dispersion, and (v) either pumping the mixture obtained at the end of step (iv) through nozzles at which point the mixture is poured onto a cold surface to set as a film and cut into appropriate individual sized units, cast as individual hemispherical pellets or sprayed into cold air, to form individual spherical pellets; or alternatively, cooling the mixture obtained at the end of step (iv), preferably at a temperature ranging from 40 to 55° C., to obtain a soft solid mixture, and then extruding the obtained soft solid mixture through a suitable sized die and cutting it into pellets.

According to a third aspect, the invention relates to the use of the solid composition according to the invention or prepared according to the method of the invention, in home care products such as laundry products, fabric softeners or household cleaners. The solid composition of the invention can be included in these home care products as an ingredient, like soaps or non-soap detergent bars, during the product's manufacture.

A laundry product comprising the solid composition as defined according to the invention or prepared according to the method of the invention is also part of the present invention, said laundry product being selected from the group consisting of powdered laundry detergents, detergent tablets and bars, and wash additives such as Vanish or OxiClean™ products, laundry detergent liquids including light duty liquids, heavy duty liquids, concentrated liquid detergents, non or low aqueous laundry liquids, unit dose sachets, soap bars, and cleaners for woollen or dark garments.

Solid laundry detergents include spray dried powders and powders made by granulation methods, tablets and bars. Detergent powders include conventional low bulk density powders (typical density from 200 to 550 $kg \cdot m^{-3}$) and high density, sometimes known as concentrated powders (typical density from 550 to 1200 $kg \cdot m^{-3}$), with average particle sizes in the range from 100 to 1000 μm, and preferably from 250 to 700 μm. Descriptions of the compositions and methods of manufacture of laundry powders can be found in EP 1 767 614; U.S. Pat. Nos. 3,985,669; 4,379,080; and 6,376,445. Descriptions of the composition and methods of manufacture of detergent tablets can be found in WO 99/41353; EP 1 123 381; and U.S. Pat. No. 635,911.

Liquid laundry detergents, specifically include light duty liquid detergents and heavy duty liquid detergents which may be structured multi-phase liquids or isotropic liquids and which may be aqueous or non-aqueous liquids. These liquids may be in bottles or unit dose sachets and they may optionally contain bleaching agents or enzymes. Descriptions of the composition and manufacture of liquid laundry detergents can be found in U.S. Pat. Nos. 5,929,022; 5,916,862; 5,731,278; 5,470,507; 5,466,802; 5,460,752; and 5,458,810.

The formulations and components of laundry products in which the solid composition of the invention may be used are well-known to those skilled in the art, from the following works:

- Formulating Detergents and Personal Care Products, A guide to Product De-velopment by L. Ho Tan Tai, ISBN 1-893997-10-3 (AOCS Press);
- Volume 71 of the Surfactant Science Series Powdered Detergents, Ed. by M. Showell ISBN 0-8247-9988-7 (Marcel Dekker Inc); and
- Volume 67 of the Surfactant Science Series Liquid Detergents ISBN 0-8247-9391-9 (Marcel Dekker Inc).

A fabric softener product comprising the solid composition as defined according to the invention or prepared according to the method of the invention is also part of the present invention, said fabric softener product being a fabric softener product for post-wash treatments, preferably tumble drier products.

A household cleaner comprising the solid composition as defined according to the present invention or prepared according to the method of the invention is also part of the present invention, said household product preferably being selected from the group consisting of hard surface cleaners, and preferably cleaners for floors.

Finally, the invention provides a method of laundering fabrics (for treating fabrics) which comprises a step of adding the solid composition as defined according to the invention or prepared according to the method of the invention to fabrics at or before the start of a wash cycle or later during a wash cycle, for example during a rinse stage. Therefore, depending on the method of washing, the solid composition of the invention can be added at different stages of the laundering process. For example, in a front loading automatic washing machine the solid composition may be added directly with the laundry at or before the start of the wash cycle. It may also be possible to stop the wash cycle and add the solid composition later in the cycle, for instance during rinse stage, which may be convenient with top loading washing machines and with hand washed articles using a bowl.

In addition to the above provisions, the invention also comprises other provisions which will emerge from the remainder of the description which follows.

Example 1

Fragrance A, having the composition of Table 2 below, was used as the free fragrance in the pellets of Example 3.

TABLE 2

Fragrance formulation A

| | Material | Weight % |
|---|---|---|
| 1 | Aldehyde C12 MNA (CAS No. 110-41-8) | 3.0 |
| 2 | Bacdanol ™ (CAS No. 28219-61-6) | 1.5 |
| 3 | Citronellol 950 (CAS No. 106-22-9) | 3.0 |
| 4 | Coumarin (CAS No. 91-64-5) | 2.0 |
| 5 | Cyclacet ™ (CAS No. 54830-99-80) | 6.0 |
| 6 | Decalactone, gamma (CAS No. 706-14-9) | 6.0 |
| 7 | Dihydromyrcenol (CAS No. 18479-58-8) | 12.0 |
| 8 | Eugenol (CAS No. 97-53-0) | 1.0 |
| 9 | Hexyl Cinnamic Aldehyde (CAS No. 101-86-0) | 12.0 |
| 10 | Hexyl Salicylate (CAS No. 6259-76-3) | 13.0 |
| 11 | Iso Raldeine 70 (CAS No. 1335-46-2) | 6.5 |
| 12 | Lavandin Oil Grosso Nat EO (CAS No. 8022-15-9) | 4.0 |
| 13 | Orbitone ™ (CAS No. 54464-57-2/666090-45-5) | 16.0 |
| 14 | Phenyl Ethyl Alcohol White Extra (CAS No. 60-12-8) | 7.0 |
| 15 | Undecavertol (CAS No. 81782-77-6) | 2.0 |
| 16 | Yara Yara (CAS No. 93-04-9) | 5.0 |

Example 2

Fragrance B, having the composition of Table 3 below, was incorporated into friable core-shell microcapsules, and the friable core-shell microcapsules containing the encapsulated fragrance were then incorporated into the pellets of Example 3.

TABLE 3

Fragrance formulation B

| | Material | Weight % |
|---|---|---|
| 1 | Isobornyl acetate (CAS No. 125-12-2) | 25.0 |
| 2 | Camphor gum powder synthetic (CAS No. 464-49-3) | 15.0 |
| 3 | Lilial (CAS No. 80-54-6) | 15.0 |
| 4 | Eucalyptol (CAS No. 470-82-6) | 8.0 |
| 5 | Ethyl-2-methylpentanoate (CAS No. 39255-32-8) | 6.0 |
| 6 | Cedrol (CAS No. 77-53-2) | 6.0 |

TABLE 3-continued

| Fragrance formulation B | | |
|---|---|---|
| | Material | Weight % |
| 7 | Allyl heptoate (CAS No. 149-19-8) | 5.0 |
| 8 | Styrallyl acetate (CAS No. 93-92-5) | 5.0 |
| 9 | 2 Methylundecanal (CAS No. 110-41-8) | 5.0 |
| 10 | Vertenex ™ (CAS No. 32210-23-4) | 5.0 |
| 11 | Coumarin (CAS No. 91-64-5) | 3.0 |
| 12 | Delta damascone (CAS No. 57378-68-4) | 2.0 |

Preparation of the Encapsulated Fragrance Preparation, i.e. Friable Core-Shell MicroCapsules Containing Fragrance B The fragrance raw materials used were Takasago ingredients and the other chemical ingredients were purchased from Sigma Aldrich.

An aqueous phase was prepared by dissolving 4.0 g of poly(vinyl alcohol), hydrolyzed to 87-89%, $M_w$=85000-124000 g·mol$^{-1}$, in 196.0 g of water. An oil phase was prepared by mixing 85.0 g of fragrance B, 13.7 g of 1,4-butane diol dimethacrylate, 13.1 g of methacrylic acid, 5.2 g of methyl methacrylate and 0.9 g of lauroyl peroxide. This mixture was stirred until complete dissolution of the lauroyl peroxide.

The aqueous phase and the oil phase were placed into a 500 mL-batch reactor equipped with a condenser, a thermometer, a nitrogen inlet and a deflocculating blade (diameter 4 cm). During all the process, the mixture was stirred at 900 rpm and nitrogen was bubbled through the mixture to remove oxygen. First, the mixture was heated from room temperature to 35° C. within 20 min and kept at 35° C. for 1 hour. The resultant preparation was then heated to 70° C. within 30 min and kept at 70° C. for 4 hours. Finally, the resultant encapsulated fragrance preparation was cooled to room temperature within 1 hour.

The mean particle size of the microcapsules from the encapsulated fragrance preparation was determined by laser diffraction with a Horiba (registered trademark) LA-950V2 analyser (volume median diameter D(v, 0.5)), and was 38.6 μm. Solids content was determined as 36% by measuring weight loss of a sample of capsule dispersion on drying for 1 hour at 120° C.

This encapsulated fragrance preparation was used in the subsequent examples.

Example 3

Preparation of Pellets

Raw Materials

Polipan 4000™ (Polyethylene glycol, $M_w$=4000 g·mol$^{-3}$), Polipan 6000™ (Polyethylene glycol, $M_w$=6000 g·mol$^{-1}$) and Cestopal 80M™ (cetylstearyl alcohol, 80EO), were both supplied by Industria Chimica Panzeri (in Bergamo).

Sodium bicarbonate, sodium sulfate, PEG 2000, PEG 35000 and PEG 100000 (Polyethylene glycol, $M_w$=2,000 g·mol$^{-1}$, 35,000 g·mol$^{-1}$ and 100,000 g·mol$^{-1}$, respectively), were supplied by Sigma Aldrich.

Sodium carbonate was supplied by Brenntag, and sodium dihydrogen citrate was supplied by Alfa Aesar.

Liquitint Blue HP™ was supplied by Milliken Corporation.

Protocol

Suitable amounts of polyethylene glycol(s) and Cestopal 80M™ were accurately weighed into a beaker and then melted in an oven set at 80° C. Colorant was mixed into the encapsulated fragrance preparation, and represented 0.015% by weight of the final pellets composition. Then, accurately weighed quantities of the inorganic salt, the fragrance A and the encapsulated fragrance preparation and colorant mixture were added to the liquid and mixed continuously until the ingredients were homogeneously dispersed. Throughout the addition and mixing steps the sample was held in a thermostatted water bath at 80° C. The homogeneous dispersion was sampled with a pipette and deposited drop by drop onto aluminum foil laid over a cold glass plate (freshly taken out or a refrigerator set at 4° C.). The droplets solidified forming hemispherical pellets with typical weights in the range of 20-80 mg. Table 4 below gives the compositions of a series of pellets produced according to the protocol of Example 3.

TABLE 4

| Compositions tested | | | | | | | | | |
|---|---|---|---|---|---|---|---|---|---|
| Example | PEG 2000 (wt %) | Polipan 4000 ™ (wt %) | Polipan 6000 ™ (wt %) | PEG 35000 (wt %) | PEG 100000 (wt %) | Cestopal 80M ™ (wt %) | Inorganic Salt (wt %) | Fragrance A (wt %) | Encapsulated fragrance preparation (wt %) |
| 3.01 | — | — | 54.9 | — | — | 36.6 | — | 6.0 | 2.5 |
| 3.02 | — | — | 51.9 | — | — | 34.6 | Sodium bicarbonate 5.0 | 6.0 | 2.5 |
| 3.03 | — | — | 48.9 | — | — | 32.6 | Sodium bicarbonate 10.0 | 6.0 | 2.5 |
| 3.04 | — | — | 42.9 | — | — | 28.6 | Sodium bicarbonate 20 0 | 6.0 | 2.5 |
| 3.05 | — | — | 36.9 | — | — | 24.6 | Sodium bicarbonate 30.0 | 6.0 | 2.5 |
| 3.06 | — | — | 42.9 | — | — | 28.6 | Sodium sulfate 20.0 | 6.0 | 2.5 |
| 3.07 | — | — | 42.9 | — | — | 28.6 | Sodium dihydrogen citrate 20.0 | 6.0 | 2.5 |
| 3.08 | — | — | 42.9 | — | — | 28.6 | Sodium carbonate 20.0 | 6.0 | 2.5 |
| 3.09 | — | — | 91.5 | — | — | — | — | 6.0 | 2.5 |
| 3.10 | — | — | 61.5 | — | — | — | Sodium bicarbonate 30.0 | 6.0 | 2.5 |
| 3.11 | — | — | 54.2 | — | — | 36.3 | Sodium bicarbonate 1.0 | 6.0 | 2.5 |

TABLE 4-continued

| Compositions tested | | | | | | | | | |
|---|---|---|---|---|---|---|---|---|---|
| Example | PEG 2000 (wt %) | Polipan 4000 ™ (wt %) | Polipan 6000 ™ (wt %) | PEG 35000 (wt %) | PEG 100000 (wt %) | Cestopal 80M ™ (wt %) | Inorganic Salt (wt %) | Fragrance A (wt %) | Encapsulated fragrance preparation (wt %) |
| 3.12 | — | 42.9 | — | — | — | 28.6 | Sodium bicarbonate 20.0 | 6.0 | 2.5 |
| 3.13 | — | 30.0 | — | — | 12.9 | 28.6 | Sodium bicarbonate 20.0 | 6.0 | 2.5 |
| 3.14 | — | 30.0 | — | 12.9 | — | 28.6 | Sodium bicarbonate 20.0 | 6.0 | 2.5 |
| 3.15 | — | — | — | 42.9% | — | 28.6 | Sodium bicarbonate 20.0 | 6.0 | 2.5 |

Example 4

Measurement of the Pellet Dissolution Time

Protocol 1 g of pellets of similar length (and each weighing about 20 mg) was dissolved in a beaker containing 100 g of deionized water at 23° C. The liquid was agitated with an overhead mixer at 120 rpm. This speed was selected to ensure the presence of a small vortex in order to allow constant motion of the pellets in water.

The time necessary to achieve complete visual dissolution of the pellets was recorded, and is shown in Table 5 below. The measurement was repeated three times and an average of the three measurements was made, and rounded to the nearest decade. For every experiment the average values agreed to within 20 seconds.

TABLE 5

| Dissolution time | |
|---|---|
| Example | Dissolution time (seconds) |
| 3.01 | 500 |
| 3.02 | 480 |
| 3.03 | 440 |
| 3.04 | 380 |
| 3.05 | 340 |
| 3.06 | 350 |
| 3.07 | 370 |
| 3.08 | 350 |
| 3.09 | 290 |
| 3.10 | 260 |
| 3.11 | 481 |
| 3.12 | 376 |

It can be seen that by varying the proportions of polyalkoxylate (b) and salt of inorganic or $C_1$-$C_6$-alkyl organic acid (e), it is possible to increase or decrease the pellets dissolution by a factor of 2.

Example 5

Agglomeration Test

A layer of 1 cm of pellets was set in a tall form glass beaker (diameter=5 cm) and compressed vertically by a piston. A pressure of 500 Pa was applied by adding a suitable weight on top of the piston.

The cylinder was kept for 1 or 3 days (24 or 72 hours) at room temperature (23° C.) or at 40° C. in an oven. The agglomeration state of the pellets was then checked by tilting the cylinder and monitoring the flow or absence of flow of the pellets.

The results presented in Table 6 below were obtained.

TABLE 6

| Agglomeration results | | | |
|---|---|---|---|
| Example | Time | Room temperature | 40° C. |
| 3.01 | 1 day | very slight agglomeration | no flow |
| 3.01 | 3 days | very slight agglomeration | no flow |
| 3.02 | 1 day | free flowing | free flowing |
| 3.02 | 3 days | free flowing | free flowing |
| 3.04 | 1 day | free flowing | free flowing |
| 3.04 | 3 days | free flowing | very slight agglomeration |
| 3.11 | 1 day | free flowing | free flowing |
| 3.11 | 3 days | free flowing | free flowing |
| 3.12 | 1 day | free flowing | free flowing |
| 3.12 | 3 days | free flowing | free flowing |
| 3.13 | 1 day | free flowing | free flowing |
| 3.13 | 3 days | free flowing | free flowing |
| 3.14 | 1 day | free flowing | free flowing |
| 3.14 | 3 days | free flowing | free flowing |
| 3.15 | 1 day | free flowing | free flowing |
| 3.15 | 3 days | free flowing | free flowing |

The results show that the pellets of the invention are better able to withstand higher temperatures without becoming sticky which makes the product more suitable for hotter climates.

Example 6

Laundry Performance Test

The pellets were then used in a wash test.

The washing machine used was a Miele Softtronic W3268, Express cycle (40° C., 40 minutes cycle, spinning at 1300 rpm). The machine was loaded with 2 kg terry towels. 20 g of pellets were added with the towels, in the drum, before the beginning of the cycle. No detergent or softener was used. The towels were line dried overnight. The performance was assessed 24 hours after the wash by a panel of three trained evaluators, rating olfactive intensity on a scale of 0 (no odor) to 5 (very strong odor), before rubbing and after rubbing the fabric to activate the capsules.

TABLE 7

| Laundry performance results | | | |
|---|---|---|---|
| Example | Time | Pre-rub performance | Post-rub performance |
| 3.01 | 1 day after production, stored at room temperature | 2.5-3 | 4-4.5 |
| 3.01 | 30 days after production, stored at 40° C. | 2.5 | 4 |
| 3.04 | 1 day after production, stored at room temperature | 2.5-3 | 4-4.5 |
| 3.04 | 30 days after production, stored at 40° C. | 2.5 | 4 |

These results do not show negative effects from the incorporation of sodium bicarbonate in the pellets.

While the invention has been described in detail and with reference to specific embodiments thereof, it will be apparent to one skilled in the art that various changes and modifications can be made therein without departing from the spirit and scope thereof. This application is based on European Patent Application No. 16306041.1 filed on Aug. 9, 2016, the entire subject matter of which is incorporated herein by reference.

INDUSTRIAL APPLICABILITY

In the present invention, it is possible to provide improved formulations compared with those of the prior art.

The invention claimed is:

1. A solid composition comprising:

(a) from 30 to 65% by weight of a polyethylene glycol, (b) from 1 to 40% by weight of a $C_8$-$C_{22}$-alkyl polyalkoxylate comprising at least 40 alkoxylate units, (c) from 0.5 to 15% by weight of free fragrance, (d) from 0.1 to 15% by weight of encapsulated fragrance, and (e) from 1 to 35% by weight of an alkali metal salt, an alkaline earth metal salt or a salt of an inorganic or $C_1$-$C_6$-alkyl organic acid, or a mixture thereof.

2. The solid composition of claim 1, wherein said polyethylene glycol has an average molecular weight from 4,000 to 100,000 mass units.

3. The solid composition of claim 1, wherein said $C_8$-$C_{22}$-alkyl polyalkoxylate is selected from the group consisting of polyoxyethylene fatty acid esters and ethoxylate fatty alcohols.

4. The solid composition of claim 1, wherein said free fragrance comprises at least 50% by weight of fragrance ingredients having a ClogP from 3.30 to 6.50.

5. The solid composition of claim 1, wherein said encapsulated fragrance is contained in microcapsules which have an average particle size from 1 to 500 μm.

6. The solid composition of claim 1, wherein said encapsulated fragrance is contained in microcapsules which are formaldehyde free.

7. The solid composition of claim 1, wherein said alkali metal salt, alkaline earth metal salt or salt of an inorganic or $C_1$-$C_6$-alkyl organic acid, or mixture thereof, represents from 5 to 35% by weight of the solid composition.

8. The solid composition of claim 1, wherein said alkali metal salt, alkaline earth metal salt or salt of an inorganic or $C_1$-$C_6$-alkyl organic acid is a sodium, potassium, calcium or ammonium salt of an inorganic or $C_1$-$C_6$-alkyl organic acid, or a mixture thereof.

9. The solid composition of claim 8, wherein said sodium, potassium, calcium or ammonium salt of an inorganic acid is selected from sodium, potassium, calcium and ammonium salts of hydrochloric, nitric, phosphoric, sulfuric or carbonic acid.

10. The solid composition of claim 8, wherein said sodium, potassium, calcium or ammonium salt of $C_1$-$C_6$-alkyl organic acid is selected from sodium, potassium, calcium and ammonium salts of acetic, propionic, lactic, citric or succinic acid.

11. The solid composition of claim 1, wherein said solid composition is in the form of powder, flakes or pellets.

12. The solid composition of claim 1, wherein said $C_8$-$C_{22}$-alkyl polyalkoxylate is selected from the group consisting of polyoxyethylene fatty acid esters and ethoxylate fatty alcohols comprising from 40 to 200 oxyethylene units.

13. The solid composition of claim 1, wherein said encapsulated fragrance is contained in microcapsules which have an average particle size from 5 to 200 μm.

14. The solid composition of claim 1, wherein said alkali metal salt, alkaline earth metal salt or salt of an inorganic or $C_1$-$C_6$-alkyl organic acid, or mixture thereof, represents from 10 to 35% by weight of the solid composition.

15. The solid composition of claim 1, wherein said salt of an inorganic acid is sodium bicarbonate and/or sodium chloride.

16. The solid composition of claim 1, wherein said salt of $C_1$-$C_6$-alkyl organic acid is one or more selected from the group consisting of sodium acetate, sodium citrate and sodium dihydrogen citrate.

17. The solid composition of claim 1, wherein said solid composition is in the form of pellets.

18. A laundry product comprising the solid composition as defined in claim 1, wherein said laundry product is selected from the group consisting of powdered laundry detergents, detergent tablets and bars, wash additives, laundry detergent liquids including light duty liquids, heavy duty liquids, concentrated liquid detergents, non or low aqueous laundry liquids, unit dose sachets, soap bars, and cleaners for woollen or dark garments.

19. A fabric softener product comprising the solid composition as defined in claim 1, wherein said fabric softener product is a fabric softener product for post-wash treatments.

20. A household cleaner comprising the solid composition as defined in claim 1.

21. A method of making the solid composition as defined in claim 1, in the form of pellets, said method comprising the steps of:

(i) mixing 30-65% by weight of a polyethylene glycol(s) with 1-40% by weight of a $C_8$-$C_{22}$-alkyl polyalkoxylate comprising at least 40 alkoxylate units, (ii) melting the mixture obtained at the end of step (i) at a temperature higher than the melting points of the polyethylene glycol(s) and the $C_8$-$C_{22}$-alkyl polyalkoxylate comprising at least 40 alkoxylate units, (iii) adding to the mixture obtained at the end of step (ii) 0.5-15% by weight of a free fragrance, 0.1-15% by weight of an encapsulated fragrance, and 1-35% by weight of an alkali metal salt, an alkaline earth metal salt or a salt of an inorganic or $C_1$-$C_6$-alkyl organic salt, or a mixture thereof, in any order, (iv) mixing the mixture obtained at the end of step (iii) to form a uniform dispersion, and (v) either pumping the mixture obtained at the end of step (iv) through nozzles at which point the mixture is poured onto a cold surface to set as a film and cut into individual sized units, cast as individual hemispherical pellets or sprayed into cold air, to form individual spherical pellets; or alternatively cooling the mixture obtained at the end of step (iv) to obtain a soft solid mixture, and then extruding the obtained soft solid mixture through a die and cutting it into pellets.

22. A laundry product comprising the solid composition as prepared according to the method of claim 21, wherein said laundry product is selected from the group consisting of powdered laundry detergents, detergent tablets and bars, wash additives, laundry detergent liquids including light duty liquids, heavy duty liquids, concentrated liquid detergents, non or low aqueous laundry liquids, unit dose sachets, soap bars, and cleaners for woollen or dark garments.

23. A fabric softener product comprising the solid compositions as prepared according to the method of claim 21, wherein said fabric softener product is a fabric softener product for post-wash treatments.

24. A household cleaner comprising the solid composition as prepared according to the method of claim 21.

* * * * *